United States Patent [19]

Rabusin

[11] Patent Number: 4,990,828

[45] Date of Patent: Feb. 5, 1991

[54] MERCURY VAPOR RELEASING GETTER TAPE USEFUL IN THE MANUFACTURE OF COLD CATHODES FOR FLUORESCENT LAMPS

[75] Inventor: Elio Rabusin, Milan, Italy

[73] Assignee: SAES Getter SpA, Milan, Italy

[21] Appl. No.: 375,732

[22] Filed: Jul. 5, 1989

[30] Foreign Application Priority Data

Sep. 12, 1988 [IT] Italy ..... 21900/88

[51] Int. Cl.[5] ..... H01J 7/10; H01J 7/18; H01J 7/20

[52] U.S. Cl. ..... 313/546; 313/556; 313/558; 313/562; 313/565

[58] Field of Search ..... 313/546, 556, 558, 559, 313/562, 565, 566

[56] References Cited

U.S. PATENT DOCUMENTS 4,107,565 8/1978 Isojima et al. ..... 313/565

FOREIGN PATENT DOCUMENTS 10679 4/1975 Japan .

*Primary Examiner*—Kenneth Wieder

*Attorney, Agent, or Firm*—David R. Murphy

[57] ABSTRACT

There is provided a metallic tape supporting a mercury vapor releasing material, preferably $Ti_3Hg$, admixed with a non-evaporable getter metal, preferably an alloy of 84% Zr—15% Al, contained within a continuous series of depressions within the tape. The depressions form a successive series of pairs of depressions preferably each having an oval shape. Each pair of oval shaped depressions is separated by a distance greater than the distance separating the individual oval shapes. The tape can then be cut between each pair of depressions to form a small strip containing two depressions. Such a small strip can then be folded through an angle of approximately 180° about an axis, in the plane of the tape midway between the depressions, perpendicular to the tape length. This folded strip can then be welded to a support and used as a cold cathode electrode in a miniature fluorescent lamp. The cathode can be heated during a manufacturing process to release mercury and subsequently act as a cold cathode and getter device.

5 Claims, 1 Drawing Sheet

MERCURY VAPOR RELEASING GETTER TAPE USEFUL IN THE MANUFACTURE OF COLD CATHODES FOR FLUORESCENT LAMPS

BACKGROUND OF THE INVENTION

Mercury dispensing getter devices are well known in the art. See for example Japanese Utility Model Application Publication No. 50-10679 and U.S. Pats. No. 3,722,976; 3,657,589 and 3,733,194 among others.

However such publications give no teachings regarding the miniaturization of cold cathode fluorescent lamps which are required, for instance, in the backlighting of liquid crystal displays for automobile instrument panels, pocket television sets, and the like, or simply for lighting purposes.

One particular attempt to produce a miniaturized cold cathode fluorescent lamp has been to use two small pieces of a strip coated with both $Ti_3Hg$ and an alloy of 84% Zr—16% Al spot welded to wire support leads. However these cathodes are still relatively large and they also have the defect that insufficient mercury is released to ensure the desirable lifetime of the fluorescent lamp.

OBJECTS OF THE PRESENT INVENTION

It is therefore an object of the present invention to provide an improved metallic tape supporting a mercury vapour releasing material admixed with a non-evaporable getter metal in a continuous series of depressions within said tape the depressions forming successive pairs of individual depressions each pair of depressions being separated by a distance greater than the distance separating the individual depressions, useful in the manufacture of a cold cathode for a miniaturized fluorescent lamp.

It is another object of the present invention to provide an improved cold cathode for use in the manufacture of a miniaturized fluorescent lamp.

It is yet a further object of the present invention to provide an improved miniaturized fluorescent lamp.

These and other objects and advantages of the present invention will become apparent with reference to the following description and drawings wherein:

DETAILED DESCRIPTION OF THE INVENTION

Figure 1:
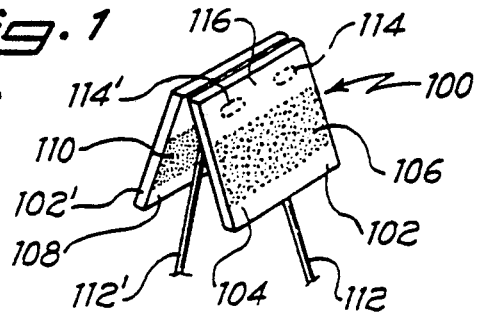
Fig. 1 PRIOR ART
FIG. 1 shows a perspective view of a prior art cold cathode for use in a fluorescent lamp.

Referring now to the drawings and in particular to FIG. 1 there is shown a prior art cold cathode electrode 100 comprising two strips 102, 102' of nickel plated iron. Outer facing surface of strip 102 has pressure bonded thereon a layer 106 of powdered 84% Zr—16% Al non-evaporable getter alloy. The outer surface (not shown) of strip 102' has a similar layer. Inner facing surface 108 of strip 102' has a layer 110 of powdered $Ti_3Hg$ mercury releasing intermetallic compound. Strips 102, 102' can be cut from continuous lengths of strip commercially available under the code name St 101-505/CTL/NI/6.3-3 from SAES GETTERS S.p.A. Milan, Italy.

Strips 102, 102' are welded to supports 112, 112' at points 114, 114'. The welding points 114, 114' must take place in the border of the strip as shown in the border 116 of strip 102. This is to avoid any possible release of mercury or destruction of the gettering properties of the Zr-Al alloy in the assembly process of the cold cathode prior to insertion in the fluorescent tube.

As the dimensions of the strips 102, 102' are approximately 0.65 cm width by 0.6 cm length, the accurate positioning of two such strips together with the support electrodes is extremely difficult. There is a severe risk of overheating, during welding, of both the mercury releasing alloy and the non-evaporable getter alloy. Furthermore attempts to miniaturize even further the cold cathode leads to a reduction of the quantities of $Ti_3Hg$ present and hence a reduction of the quantity of mercury released within the fluorescent lamp. Also a reduction of the quantity of non-evaporable getter material present does not ensure sufficient removal of the dangerous residual gases released during the life of the fluorescent lamp.

Figure 2:
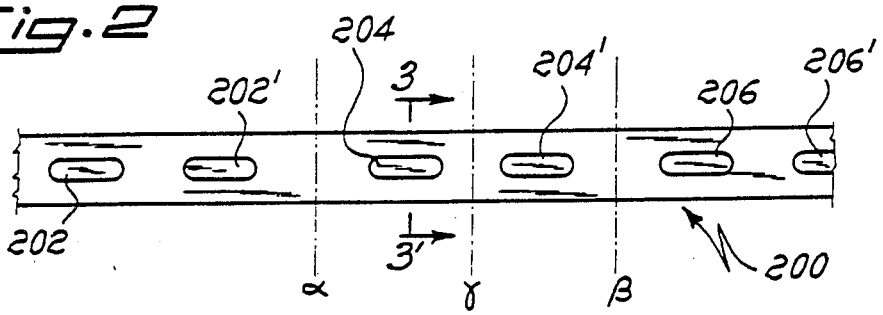
FIG. 2 shows a plan view of a mercury releasing metal getter tape of the present invention.

Referring now to FIG. 2 there is shown a metallic tape 200 of the present invention. Metallic tape 200 can be of any metal suitable for supporting a mercury vapour releasing material and a non-evaporable getter metal. Preferably tape 200 is of nickel plated iron. Tape 200 has a continuous series of depressions 202, 202', 204, 204', 206, 206'. Depressions 202, 202' form within said tape a pair of individual depressions. Successive depressions 204, 204' provide another pair of individual depressions. Again successive individual depressions 206, 206' form a further pair of depressions, and so on. Each pair of depressions is separated by a distance greater than the distance separating the individual depressions. Preferably the depressions are of approximately oval shape as shown in FIG. 2 such that their length is greater than their width. The oval shape shown in the drawings can also be described as the shape of a race track or a cartouche.

Figure 3:
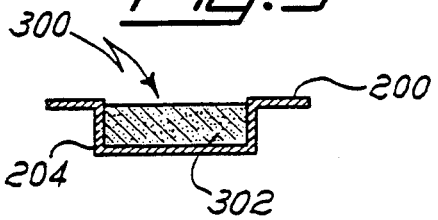
FIG. 3 is an enlarged cross-sectional view along line 3—3' of FIG. 2.

Referring now to FIG. 3 there is shown a cross-section 300 along lines 3—3' of FIG. 2 of depression 204.

Cross section 300 shows a metallic tape containing depression 204. Into depression 204 there is compressed a mercury vapour releasing material 302. Mercury vapour releasing material 302 preferably comprises a powdered mixture of intermetallic compound $Ti_3Hg$ with a powdered non-evaporable getter metal preferably comprising an alloy of 84% Zr—16% Al.

Figure 4:
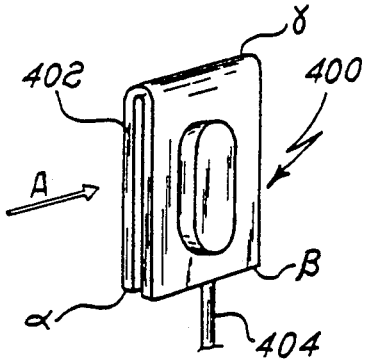
FIG. 4 is a perspective view of a cold cathode produced using a portion of the tape shown in FIG. 2.
Figure 5:
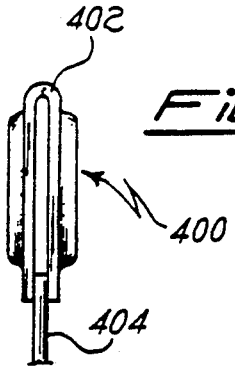
FIG. 5 is a view of the cold cathode of FIG. 4 taken along arrow A of FIG. 4.

Referring now to FIG. 4 there is shown a cold cathode 400 of the present invention. Cold cathode 400 is formed from a small length of tape 402 formed for instance by cutting a small length of tape 200 as shown in FIG. 2 along the lines indicated by alpha and beta in FIG. 2. Small strip of tape 402 is then folded along line gamma as indicated in both FIG. 4 and FIG. 2. Line gamma lies in the plane of the tape 402 midway between the two depressions within the tape 402 and perpendicular to the tape length. The tape 402 is bent through an angle of approximately 180°. As shown in FIG. 4 the bending has taken place so that the depressions face outwardly. This allows the cathode to occupy the smallest possible space. The cathode 400 may be welded to a wire support 404 as shown in both FIGS. 4 and 5. In this case the wire support 404 is shown as being internal to the cathode 400 but it will be realized that small length of tape 402 may be more closely folded and wire support 404 may be external to the cold cathode 400.

Figure 6:
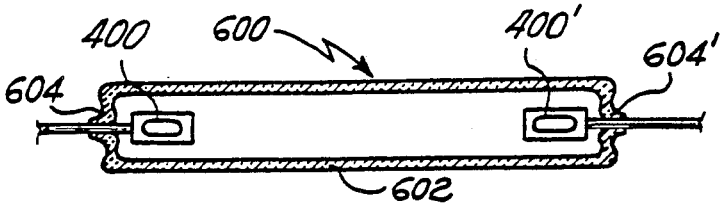
FIG. 6 s a cross sectional representation of a miniaturized fluorescent lamp utilizing a cold cathode of the present invention.

Referring now to FIG. 6 there is shown a miniature fluorescent lamp 600 comprising a cylindrical glass envelope 602 and end seals 604, 604'. Miniature fluorescent lamp 600 incorporates two cold cathodes 400, 400' being held within the miniature fluorescent lamp by means of seals 604, 604' respectively.

EXAMPLE

A continuous length of nickel plated iron strip having a width of 2.5 mm is taken and a continuous series of depressions are formed therein such that the depressions form successive pair of individual depressions. Each depression has a width of approximately 1.5 mm and a length of 3.5 mm. The separation between the individual depression of each pair is 2.5 mm whereas the separation between successive pairs of depressions is 5 mm. Each depression is filled with approximately 5 mg of a 50% by weight mixture of an intermetallic compound $Ti_3Hg$ and 50% by weight of 84% Zr—16% Al non-evaporable getter material. A cold cathode is produced by cutting a small length of the tape and folding it as described above and it is welded to a wire support. Two such electrodes are used to produce a miniature fluorescent lamp as shown in FIG. 6. The cathode can be heated during a manufacturing process to release mercury and subsequently act as a cold cathode and getter device.

Although the invention has been described in considerable detail with reference to certain preferred embodiments designed to teach those skilled in the art how best to practice the invention, it will be realized that other modifications may be employed without departing from the spirit and scope of the appended claims.

What is claimed is:

1. A metallic tape supporting a mercury vapour releasing material admixed with a non-evaporable getter metal in a continuous series of depressions within said tape the depressions forming successive pairs of individual depressions each pair of depressions being separated by a distance greater than the distance separating the individual depressions.

2. A metallic tape of nickel plated iron supporting a powdered mercury vapour releasing material comprising $Ti_3Hg$ admixed with a powdered non-evaporable getter metal comprising an alloy of 84% Zr—16% Al in a continuous series of depressions within said tape, the depressions forming successive pairs of individual oval shaped depressions each pair of oval shaped depressions being separated by a distance greater than the distance separating the individual depressions of each pair.

3. A cold cathode electrode comprising a metallic tape supporting a mercury vapour releasing material admixed with non-evaporable getter material deposited within two depressions within said tape, the tape being in the form of an inverted "U" about an axis, in the plane of the tape midway between the depressions, perpendicular to the tape length.

4. A cold cathode electrode comprising a metallic tape of nickel plated iron supporting a powdered mercury vapour releasing material comprising $Ti_3Hg$ admixed with a powdered non-evaporable getter material comprising an alloy of 84% Zr—16 % Al depositing within two depressions within said tape the depressions being of substantially oval shape, the tape being in the form of an inverted "U" about an axis, in the plane of the tape, midway between the depressions, perpendicular to the tape length.

5. A cold cathode electrode comprising:

A. a U-shaped planar metallic strip having a pair of parallel depending legs with first and second juxtaposed surfaces; and B. $Ti_3Hg$ in a depression in the first surface; and C. a non-evaporable getter metal in a depression in the second surface; and D. an electrical lead carried by the depending legs between the depending legs.

* * * * *